US006105497A

United States Patent [19]

Hermann

[11] Patent Number: 6,105,497

[45] Date of Patent: Aug. 22, 2000

[54] HAND-HELD LABELING APPARATUS

[75] Inventor: Klaus-Dieter Hermann, Hirschhorn, Germany

[73] Assignee: Cosco Industries, Inc., Spring Valley, N.Y.

[21] Appl. No.: 09/336,637

[22] Filed: Jun. 18, 1999

[51] Int. Cl.[7] ..... B65C 11/02

[52] U.S. Cl. ..... 101/288; 156/384

[58] Field of Search ..... 101/288, 292, 101/389.1, 291, 383; 400/82; 156/384

[56] References Cited

U.S. PATENT DOCUMENTS

| | | | |
|---|---|---|---|
| 3,180,259 | 4/1965 | McKay | 101/378 |
| 3,714,894 | 2/1973 | Robinson | 101/382 |
| 4,010,684 | 3/1977 | LaPointe, Jr. | 101/382 |
| 4,154,166 | 5/1979 | Knott et al. | 101/291 |
| 4,221,164 | 9/1980 | Krulwich | 101/109 |
| 4,369,085 | 1/1983 | Hermann | 156/384 |
| 4,793,889 | 12/1988 | Becker | 101/288 |
| 4,853,068 | 8/1989 | Becker | 101/288 |
| 4,854,235 | 8/1989 | Lyon | 101/389.1 |
| 4,947,747 | 8/1990 | Hermann | 101/288 |

*Primary Examiner*—John S. Hilten
*Assistant Examiner*—Leslie J. Grohusky
*Attorney, Agent, or Firm*—Senniger, Powers, Leavitt & Roedel

[57] ABSTRACT

A hand-held manually operated labeling apparatus with a housing containing a support for a roll of labels, an interchangeable printing mechanism of either the band-type or slug-type, a label advancing mechanism and a label dispensing mechanism. The two types of printing mechanisms are constructed and arranged so that the print indicia of either mechanism to print a label will be disposed in the same position when they impact a label to be printed as the apparatus is manually actuated. A single housing for the two printing mechanisms supports the various parts for either printing mechanism type. A pivotable front plate in the labeling apparatus housing permits access to slug plates on the slug-type printing mechanism for changing them while that mechanism is mounted in the labeling apparatus.

9 Claims, 5 Drawing Sheets

HAND-HELD LABELING APPARATUS

FIELD OF THE INVENTION

The present invention relates to hand-held labeling apparatus and more particularly to such apparatus that are used, for example, for printing individual labels used to mark the prices of goods in retail stores such as supermarkets and the like, and are manually actuated by the user to print and dispense labels detachably supported by a backing web which is stored within the apparatus.

BACKGROUND OF THE INVENTION

There are many different constructions of hand-held labeling apparatus of the general type to which the present invention pertains, such as those disclosed in U.S. Pat. Nos. 4,154,166, 4,369,085, and 4,947,747. All of these labeling apparatus provide a support for a roll of labels, some form of printing mechanism and a label dispensing mechanism where the label is separated from its supporting web and delivered to a surface where the label is to be applied. The printing mechanisms vary, but generally have a print-head which is movable toward and away from a platen which supports the web and label to be printed so that when the print-head contacts the label it prints the desired indicia on the label and then moves away so that the label can be advanced to the dispensing mechanism. The print-head is generally either provided with one of two types of printing mechanisms. A first type of mechanism is composed of a series of bands mounted to wheels and provided with a mechanism for rotating the wheels to move the bands so that the desired series of indicia such as a sale price, are lined up with the label to be printed. Such a mechanism is disclosed in U.S. Pat. No. 4,947,747. The second type of printing mechanism utilizes a magnet attached to the print-head to receive a metal plate which in turn has a desired indicia member attached. Indicia on this type of printing mechanism are often large and say, for example, "sale". When the plate is attached to the magnet it is positioned so as to print the indicia on the label when it contacts it. Such a print-head is disclosed in U.S. Pat. No. 4,154,166.

Because a purchaser of hand-held labeling apparatus of the general type discussed often likes to have both types of printing mechanisms, the purchaser is often required to purchase multiple hand-held labeling apparatus with the two different types of mechanisms. This, in turn, requires the manufacturer to produce and inventory these multiple forms of labeling apparatus which is inefficient and expensive.

SUMMARY OF THE INVENTION

In order to overcome the above described inefficiencies and disadvantages of the prior art labeling apparatus, it is an object of the present invention to provide a hand-held labeling apparatus which has interchangeable printing mechanisms for providing either a band-type print-head or a slug-type print-head.

It is a further object of the present invention to provide a single printing mechanism housing that can be used to house either a band-type printing mechanism or a slug-type printing mechanism which is so constructed and arranged that the print indicia of either mechanism engages the label to be printed on at the same position in the hand-held labeling apparatus.

It is a further object of the present invention to provide a hand-held labeling apparatus having a housing; a support for a roll of labels releasably secured to a backing strip and mounted to the housing so as to allow the roll to unwind along a path; a printing mechanism along the path for printing a label with selected indicia as it passes, the printing mechanism including a frame adapted to support either a band-type printing mechanism or a slug-type printing mechanism; a label dispensing mechanism along the path for dispensing printed labels; a label advancing mechanism mounted to the housing and engagable with the backing strip for moving the labels along the path from the roll to the printing mechanism and then to the dispensing mechanism; a manually operated actuating mechanism interconnecting the label printing mechanism and label advancing mechanism for moving labels along the path a predetermined distance, printing a label and dispensing a label each time the mechanism is actuated; and a front cover plate pivotally mounted to the housing and manually movable from a closed position in which it covers the printing mechanism during operation and an open position in which it allows access to the printing mechanism for changing slug plates.

It is further object of the present invention to provide such a hand-held labeling apparatus wherein the print-head has a pair of side frames for selectively supporting either at least one pair of upper and lower band-type support wheels for carrying a band-type with selected indicia for printing on the labels, or for supporting a slug plate support member therebetween.

Other and further objects will become apparent from the following detailed description of the preferred embodiment and the accompanying drawings.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
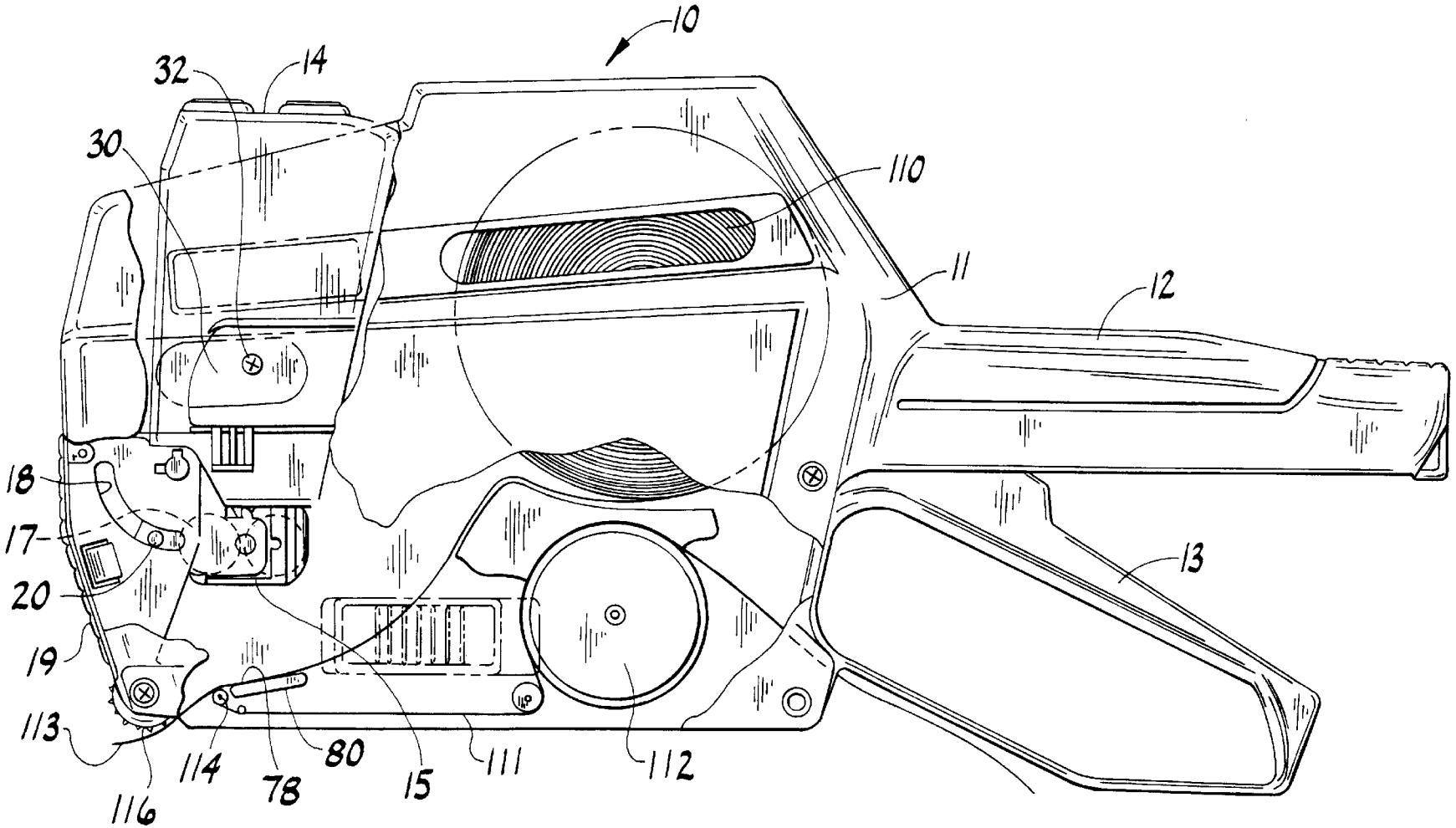
FIG. 1 is a side view, partly broken away, of an embodiment of the hand-held labeling apparatus of the present invention.

The hand-held labeling device, generally designated 10, of the present invention comprises a housing 11 made of plastic which has a handle 12 fixed to the housing 11 and a handle 13 pivotally mounted in the housing 11. Attached to the handle 13 are a pair of parallel spaced arms which support either of the two printing mechanisms disclosed herein , but are shown in FIG. 1 as carrying a band-type printing mechanism 14 located in the front part of the housing 11. When the handle 13 is in its rest or fully extended position as shown in FIG. 1, the printing mechanism 14 is in its upper most rest position and engaged at its lower end by an inking mechanism 15 which applies ink to the printing indicia at the bottom of the printing mechanism 14.

The inking mechanism 15 is mounted on a rocking lever mechanism 17 mounted to the front plate 19. The rocking lever mechanism is of a well known type and includes the guide slot 18 and pin 20 mounted in the slot to cause the inking mechanism to move out of the way of the printing mechanism as the handle 13 is squeezed toward the handle 12. The rocking lever mechanism is spring biased so that as the handle 13 is returned to its rest position the inking mechanism again engages the printing indicia to apply additional ink.

Figure 6:
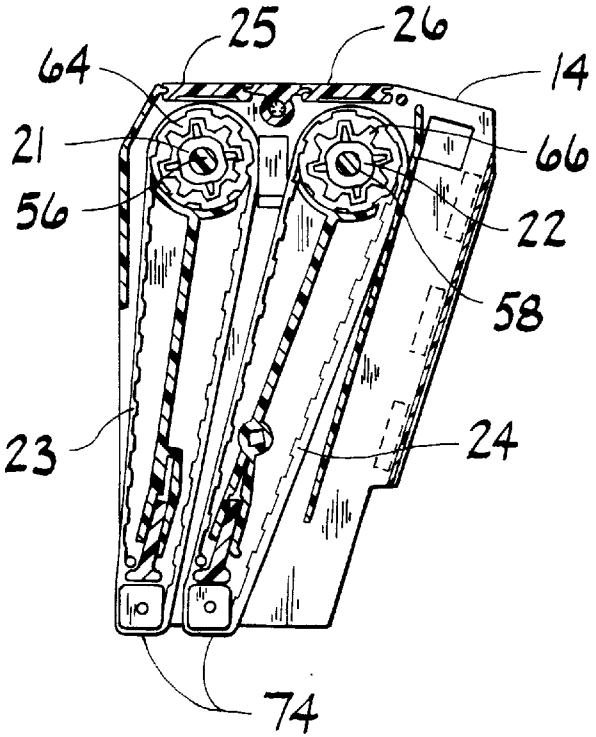
FIG. 6 is a cross-sectional view along the line 6–6 of FIG. 5.
Figure 5:
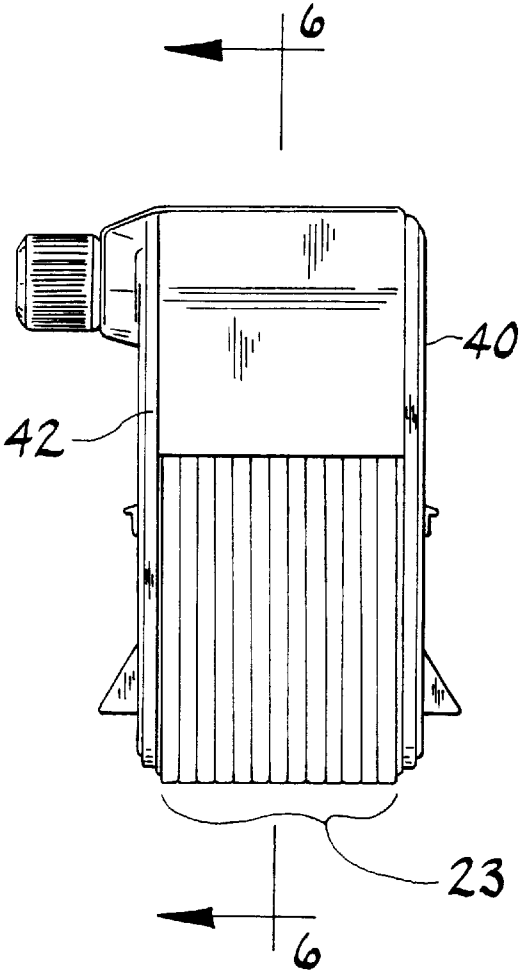
FIG. 5 is a view similar to FIG. 3, but showing the band-type mounting configuration.

The embodiment shown includes a two-line printing mechanism well known in the art, and as shown in FIGS. 5 and 6 is set by rotating two setting wheels attached to the shafts 21 and 22 which in turn rotate the type bands 23 and 24, respectively. The type on each band is duplicated at the top and bottom of the band so that the desired print at the bottom can be seen through positioning windows 25 and 26 on the top of the labeling device 10. The setting wheels are also movable axially so that type bands arranged one behind the other can each be set in the same way. Thus, several different indicia can be set and printed on each of the two-lines of print.

Figure 4:
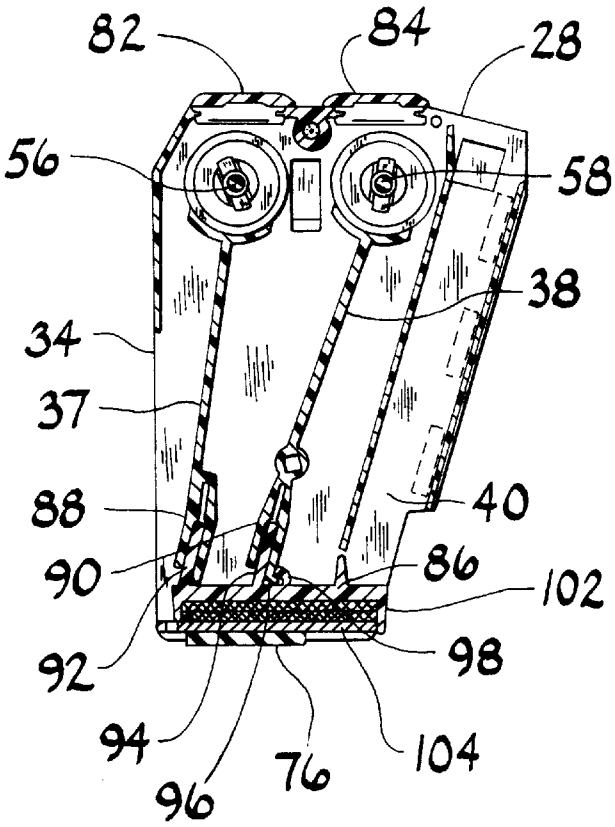
FIG. 4 is a cross-sectional view along the line 4–4 of FIG. 3.
Figure 3:
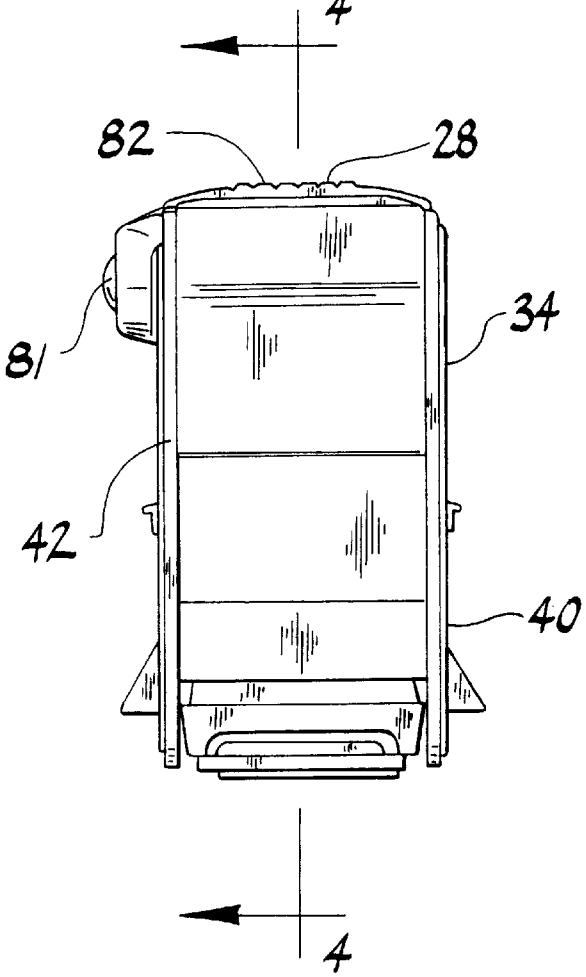
FIG. 3 is a front view of a print-head showing the slug plate mounting configuration.

Alternatively to the band-type printing mechanism 14 discussed above a slug-type printing mechanism 28, as shown in FIGS. 3 and 4, can be utilized in the hand-held labeling device of the present invention. The housing 34 of printing mechanism 28 is identical to that of printing mechanism 14 so that they are completely interchangeable in the hand-held labeling apparatus 10 of the present invention. The pair of parallel spaced arms 30, only one of which is shown in FIG. 1, attached to the handle 13 are provided with holes so that screws 32 can be placed in the holes in arms 30 and corresponding holes 33, shown in FIGS. 7 and 8, in the sides of housing 34 of the printing mechanisms 14 and 28 to hold either housing between the arms 30 for movement therewith.

Figure 8:
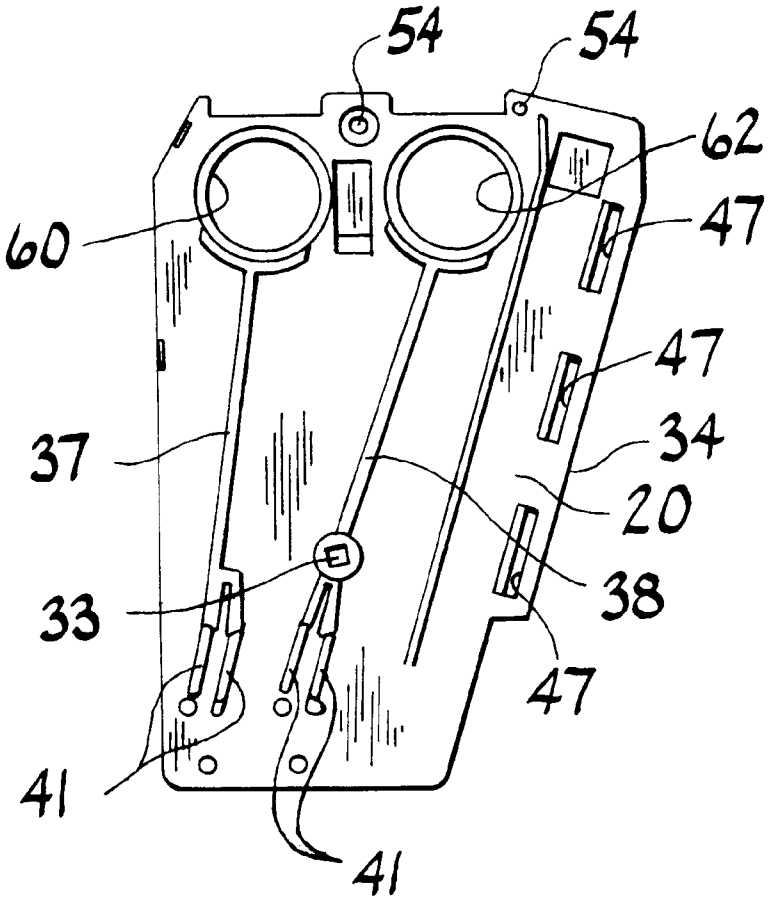
FIG. 8 is the other side frame of the print-head housing.
Figure 7:
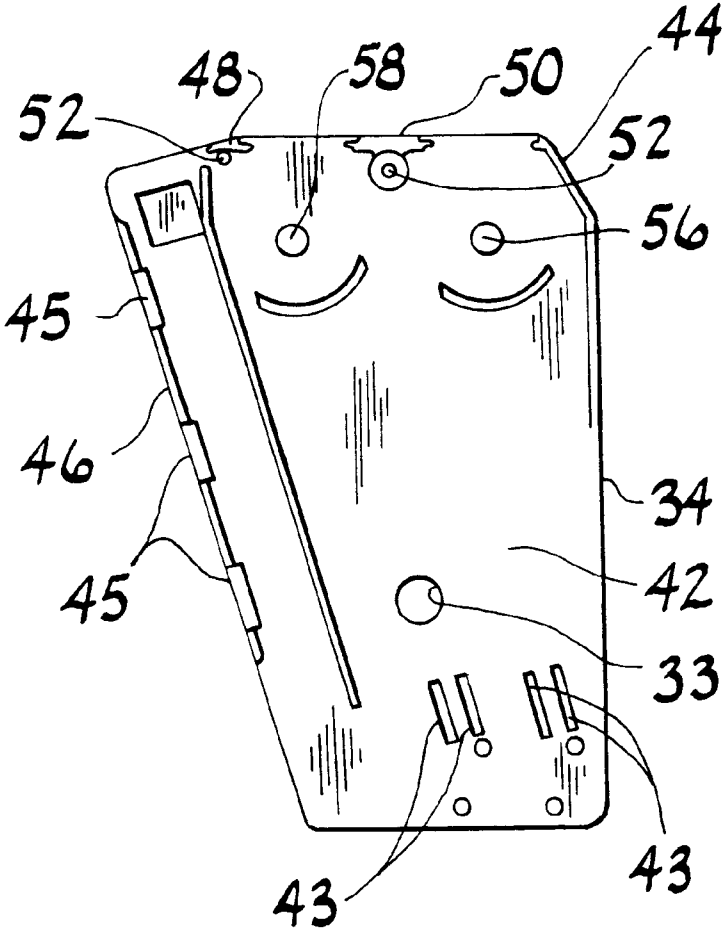
FIG. 7 is one side frame of the print-head housing.

The housing 34 is provided with internal stiffening ribs 37 and 38, as shown for example in FIG. 8, which are attached to or formed integral with housing side wall 40 and abut the opposite sidewall 42, shown in FIG. 7, and have tabs 41 which engage corresponding slots 43 in the opposite side wall 42 when the housing 34 is assembled. A front wall 44 and rear wall 46 are attached to or integrally formed with side wall 42 and abut the opposite side wall 40 and are provided with tabs 45 that engage and lock into corresponding slots 47 formed in side wall 40. Two top pieces 48 and 50, which help form the windows 25 and 26, are integrally formed with the side wall 42 and abut the opposite side wall 40 when assembled and have pins 52 formed therein which are received in corresponding holes 54.

Referring to FIGS. 5 and 6, the setting wheels for the band-type printing mechanism 14 are provided with hollow shafts 21 and 22 that are slidably received on solid shafts 56 and 58 attached to or integrally formed with side wall 42 and extend through concentric holes 60 and 62 in side wall 40, respectively, to receive the setting wheels for both rotational and axial movement. The print bands 23 and 24 and their upper support wheels 64 and 66 and lower support wheels are shown generally in FIG. 6 and will not be discussed in detail herein since they are constructed and arranged in a well known manner.

It is noted that in the present invention the lower surface of the print-type indicia 74 of the print-type printing mechanism 14, as shown in FIG. 6, is in the same position relative to housing 34 as is the print indicia 76 on the slug-type printing mechanism 28, as shown in FIG. 4. Thus, as shown in FIG. 1, as the indicia of either type of printing mechanism is moved so the indicia contacts the label 78 resting on the printing platen 80 the indicia are parallel to the label and the platen so that it applies ink evenly to the label when the handle 13 is actuated.

As best seen in FIGS. 3 and 4, when the housing 34 is being used to contain a slug-type printing mechanism 28, caps 81 are secured as by gluing to the outside of the housing to cover the holes 60 and 62 and additional caps 82 and 84, as shown in FIG. 4, are secured to the housing to cover windows 25 and 26. A slug plate support plate 86 is provided with a double bayonet connection to the ribs 37 and 38 of the housing. The ribs are provided with slots 88 and 90 extending across the entire bottom of the ribs. Corresponding tabs 92 and 94 are provided on the back of support plate 86. A lip 96 is formed along the back edge of rib 37 and a hook-shaped tab 98 is formed on the top of support plate 86 across a substantial portion of its width to engage the lip 96 and hold the support plate in position. During assembly of the slug-type printing mechanism 28 the tabs 92 and 94 are laterally aligned with their respective slots 88 and 90 and tab 98 is aligned with lip 96 and then slid laterally until the support plate engages the side wall 40. The other side wall 42 is then attached to provide a sturdy support for plate 86.

Adhesively attached to the underside of support plate 86 is a magnet 102 which captures and removably retains a slug plate 104. Any desired indicia 76 is adhesively attached to the slug 104. A plurality of such slug plates 104 with a plurality of different indicia 76 can be interchangeably applied to support plate 86 and held in place by magnet 102.

Referring again to the overall construction of the hand-held labeling apparatus 10, as shown in FIG. 1, a space is provided in the upper part of the apparatus for containing a roll of labels 110. The roll 110 is inserted into the space by swinging out the label drive assembly which is pivotally supported at one end. Such an assembly is shown in U.S. Pat. No. 4,369,085 incorporated herein by reference. The assembly includes a drive wheel 112 that is ratcheted by movement of the handle 13 to advance the web supporting the labels to be printed on. In a well known manner the labels are advanced to a printing station in which the platen 80 supports the label to be printed on. The label is then advanced to the dispensing station where the web 111 supporting the printed label makes a sharp bend around roller 114 mounted to the housing at the front edge of printing platen 80 which causes the printed label 113 to separate from the web and exit the labeler to be applied to a surface by a roller 116.

Figure 2:
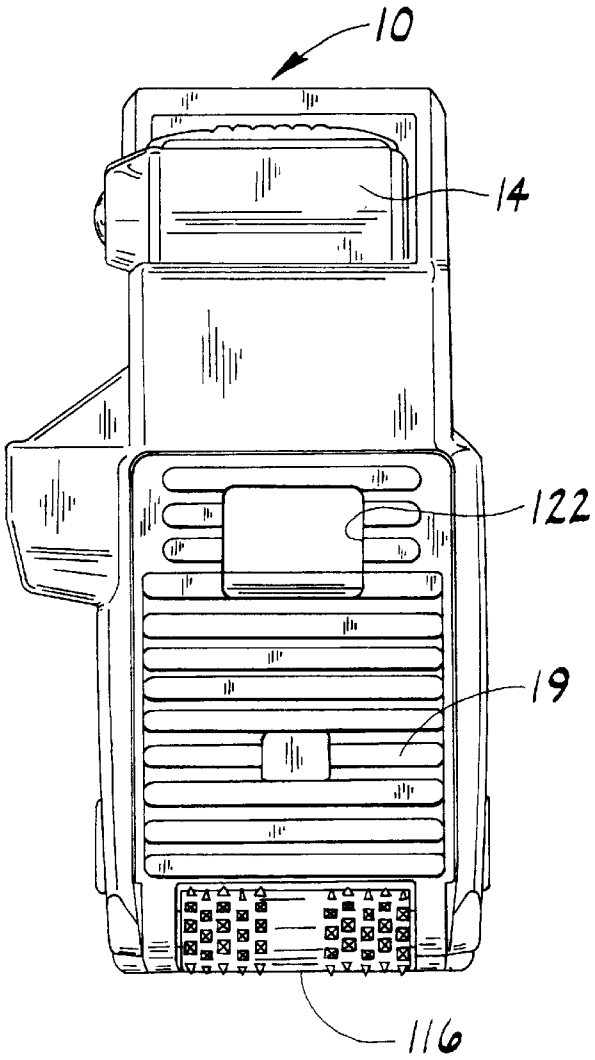
FIG. 2 is a front view of the embodiment of FIG. 1.

The front plate 19 of the labeling apparatus 10 is pivotally mounted at its lower end to the sides of the housing 11. The front plate 19 is held in its normally closed position by a locking mechanism as disclosed in U.S. Pat. No. 4,947,747 incorporated herein by reference. The small window 122, as shown in FIG. 2, allows the front plate 19 to be pivoted open by insertion of a users finger and pulling out on the front plate which withdraws the inking mechanism 15 from the interior and allows access to the lower part of the printing mechanism. When the slug-type printing mechanism 28 is being utilized, opening of the front plate 19 in this manner allows access to the slug plate 104 for removal and insertion from the printing mechanism without removing the entire printing mechanism from the labeling apparatus.

Thus, it can be seen that providing the interchangeable printing mechanisms 14 and 28 allows a hand-held labeling device to easily be assembled using either type of printing mechanism. Also, since the housings for the two types of printing mechanisms have many common parts there is less inventory to be maintained for the construction of the two mechanisms.

As various changes could be made in the above constructions without departing from the scope of the invention, it is intended that all matter contained in the above description or shown in the accompanying drawings shall be interpreted as illustrative and not in a limiting sense.

What is claimed is:

1. A hand-held labeling apparatus, comprising:

a housing;

a support for a roll of labels releasably secured to a backing strip and mounted to the housing so as to allow the roll to unwind along a path;

a printing mechanism along the path for printing a label with selected indicia as it passes, the printing mechanism including a frame having structure for interchangeably supporting a band-type printing mechanism having multiple movable bands carrying printing indicia and a slug-type printing mechanism including a detachable replaceable slug plate carrying printing indicia;

a label dispensing mechanism along the path for dispensing printed labels;

a label advancing mechanism mounted to the housing and engagable with the backing strip for moving the labels along the path from the roll to the printing mechanism and then to the dispensing mechanism;

a manually operated actuating mechanism interconnecting the label printing mechanism and label advancing mechanism for moving labels along the path a predetermined distance, printing a label and dispensing a label each time the mechanism is actuated; and a front cover plate pivotally mounted to the housing and manually movable from a closed position in which it covers the printing mechanism during operation and an open position in which it allows access to the printing mechanism for changing the slug plate in said slug-type printing mechanism.

2. A hand-held labeling apparatus as defined in claim 1 wherein the frame of the printing mechanism has a pair of side frames, and the band-type printing mechanism has at least one pair of upper and lower band-type support wheels for carrying a type band with selected indicia for printing on the labels supportable by said side frames, and the slug-type printing mechanism has a slug plate support plate supportable by said side frames.

3. A hand-held labeling apparatus as defined in claim 2 wherein the printing mechanism includes structure for positioned such that the position of the band-type indicia for printing on the label or the printing slug indicia are in the same position during engagement with a label for printing, whether the band-type or slug-type printing mechanism is utilized.

4. A hand-held labeling apparatus as defined in claim 3 wherein at least one of the pair of side frames has a receiving member and the slug plate support plate has a member for matingly engaging the receiving member to position the slug plate support plate at a predetermined location on the printing mechanism.

5. A hand-held labeling apparatus, comprising:

a housing;

support means for supporting a roll of labels releasably secured to a backing strip and mounted to the housing so as to allow the roll to unwind along a path;

printing means along the path for printing a label with selected indicia as it passes, the printing means including a frame having structure for interchangeably supporting a band-type printing mechanism having multiple movable bands carrying printing indicia and a slug-type printing mechanism including a detachable replaceable slug plate carrying printing indicia;

label dispensing means along the path for dispensing printed labels;

label advancing means mounted to the housing and engagable with the backing strip for moving the labels along the path from the roll to the printing means and then to the dispensing means;

a manually operated actuating means interconnecting the label printing means and label advancing means for moving labels along the path a predetermined distance, printing a label and dispensing a label each time the actuating means is actuated; and a front cover plate pivotally mounted to the housing and manually movable from a closed position in which it covers the printing means during operation and an open position in which it allows access to the printing means for changing the slug plate in the slug-type printing mechanism.

6. A hand-held labeling apparatus as defined in claim 5 wherein the frame of the printing means has a pair of side frames, and the band-type printing mechanism has at least one pair of upper and lower band-type support wheels for carrying a band with selected indicia for printing on the labels supportable by said side frames, and the slug-type printing mechanism has a slug plate support plate supportable by said side frames.

7. A hand-held labeling apparatus as defined in claim 6 wherein the printing means includes structure for positioning such that the position of the band indicia for printing on the label or the printing slug indicia engage the label in the same position for printing, whether the band-type or slug-type printing mechanism is utilized.

8. A hand-held labeling apparatus as defined in claim 7 wherein the printing means includes at least one of the pair of side frames having a receiving member and the slug plate support plate having a member for matingly engaging the receiving member to position the slug plate support plate at a predetermined location on the printing means.

9. A hand-held labeling apparatus, comprising:

a housing;

a support for a roll of labels releasably secured to a backing strip and mounted to the housing so as to allow the roll to unwind along a path;

a printing mechanism along the path for printing a label with selected indicia as it passes, the printing mechanism including a frame having structure for interchangeably supporting a band-type printing mechanism having multiple movable bands carrying printing indicia and a slug-type printing mechanism including a detachable replaceable slug plate carrying printing indicia;

a label dispensing mechanism along the path for dispensing printed labels;

a label advancing mechanism mounted to the housing and engagable with the backing strip for moving the labels along the path from the roll to the printing mechanism and then to the dispensing mechanism; and a manually operated actuating mechanism interconnecting the label printing mechanism and label advancing mechanism for moving labels along the path a predetermined distance, printing a label and dispensing a label each time the mechanism is actuated.

* * * * *